United States Patent [19]

Molitors

[11] 4,266,461

[45] May 12, 1981

[54] TANDEM BRAIDING SYSTEM AND COMPONENTS THEREOF

[75] Inventor: Thomas J. Molitors, Akron, Ohio

[73] Assignee: Karg Corporation, Tallmadge, Ohio

[21] Appl. No.: 54,925

[22] Filed: Jul. 5, 1979

[51] Int. Cl.[3] ..... D04C 3/12

[52] U.S. Cl. ..... 87/29; 87/20; 87/32; 87/33; 226/44; 242/75.51

[58] Field of Search ..... 226/44, 45; 242/45, 242/75.51; 87/15, 20, 29, 32, 33, 61

[56] References Cited

U.S. PATENT DOCUMENTS

| | | | |
|---|---|---|---|
| 1,908,250 | 5/1933 | Huston | 242/75.51 |
| 2,223,718 | 12/1940 | Cook | 242/75.51 X |
| 2,259,241 | 10/1941 | Cook | 242/75.51 |
| 2,918,777 | 12/1959 | Reeve et al. | 87/29 X |
| 3,087,663 | 4/1963 | Anderson | 226/44 |
| 3,099,932 | 8/1963 | Ege et al. | 87/29 X |
| 3,183,583 | 5/1965 | Ostermann | 87/33 X |
| 3,756,117 | 9/1973 | De Young | 87/29 |
| 3,802,312 | 4/1974 | Brand | 87/29 |
| 3,905,533 | 9/1975 | Corse | 226/44 |
| 3,912,145 | 10/1975 | Meihofer | 226/44 |

FOREIGN PATENT DOCUMENTS

| | | | |
|---|---|---|---|
| 551106 | 2/1943 | United Kingdom | 226/44 |

*Primary Examiner*—John Petrakes
*Attorney, Agent, or Firm*—Mack D. Cook, II

[57] ABSTRACT

A system and components thereof to control the covering of a flexible core with reinforcing strands by rotary braiding on tandem or adjacent machines. When used to control covering the core with multiple-braided strands formed in successive passes through tandem machines, the system has mechanical and electrical components which function to monitor and detect positions of the core, with a first covering of braided strands thereon, within and relative to the predetermined parameters of a chorded festoon and a zone of operational tolerance established between the machines, and to regulate the operating speed of both machines and of one machine relative to the other machine. In an alternative mode of control, the system has components permitting individual operation of each machine.

7 Claims, 14 Drawing Figures

TANDEM BRAIDING SYSTEM AND COMPONENTS THEREOF

BACKGROUND OF THE INVENTION

The invention relates to a system and components thereof to control the covering of a core element with strands of reinforcing material by rotary braiding on tandem or adjacent machines.

As an operating unit, a rotary braiding machine suitable for being controlled according to the invention is now known, ad is described in the prior art.

The following United States Patents, now owned by the inventor's assignee, Karg Corporation, Tallmadge, Ohio U.S.A., disclose and claim various components of a rotary braiding machine suitable for control according to the invention: U.S. Pat. Nos. 3,756,117; 3,756,523: 3,756,533; and 3,757,904, each Sept./1973; and, 3,802,643, April/1974.

A machine suitable for being controlled according to the invention will have a rotating braiding mechanism and a revolving capstan drum for moving a flexible core element. The braiding mechanism and the capstan drum are powered by a variable speed motor.

The braiding mechanism includes a spool holder drive mechanism for actuating relative movement of a set of outer spools and a set of inner spools along circular paths in opposite directions. A material strand from each spool is let off toward the "work center" for braiding as to each other and around a moving flexible core element introduced coaxially of the braiding mechanism. The capstan includes a drive mechanism for actuating a revolving movement of a capstan drum. Multiple loops of a composite article, the core element with a covering of braided strands thereon, are wrapped around the drum in frictional engagement therewith.

In all known machine performed operations for covering a core element with a layer of braided strands, the "braid angle" or pitch of the braided strands will be established by the rate or speed of lineal progression during the circuar or wrapping movement of strands from the spools around the core element.

In the rotary braiding machines controlled according to the invention, the braid angle is a resultant of three factors: (1 ) outer diameter of the core element; (2) rate of lineal movement of the core element when passing through the "work center"; and, (3) rate of wrapping movement of the strands around the core element when in the "work center."

For any given dimensional factor (1), the greater the difference between the movement of factor (2) and the movement of factor (3), the lower or steeper the resultant braid angle. Conversely, for a given factor (1), a smaller difference between the movements of factors (2) and (3) will produce a product with a higher or flatter braid angle.

Control of tandem braiding machines according to the invention contemplates that each machine will have as a discrete operational component thereof an adjustable proportional control means to determine a specific braid angle for the strand covering on the core element. Each proportional control means will synchronize the revolving movement of the capstan drum (providing a lineal movement of a core element) and the circular movement of the sets of outer and inner spools (providing a wrapping movement of the strands). It is preferred that the power input to each proportional control means be from a single variable speed drive motor mounted on each machine frame.

The products which will be manufactured according to the invention are known, conventional, many and varied. The products may be plastic or rubber hose, cable, cord, line, or even rope. For this disclosure, the product shown is a very long length of rubber tubing reinforced by double-braided strands and intended for an end use, in suitable lengths and with suitable end fittings or couplings, in the transmission of hydraulic fluids under high pressure. Such a product is generically called "industrial hose."

Before now, there have been several types of techniques for continuous manufacture of industrial hose products disclosed in the prior art.

Commercial manufacturers of industrial hose products have long known of the company W & M Ostermann, Wuppertal-Barmen, Germany. The "Ostermann" equipment has included a horizontally operating machine with two rotating braiding mechanisms, "first pass" and "second pass," arranged symmetrically around a steel pole or rigid mandrel and having a caterpillar haul-off for the mandrel and multiple-braided product. U.S. Pat. No. 3,183,583, Ostermann, May/1965, discloses a horizontal machine used with two winding heads but otherwise structurally equivalent to the known "Ostermann" braiding machine.

A continuous process for the manufacture of reinforced hose using horizontally arranged tandem units for applying reinforcement "in the form of knitted, woven, braided or lapped textile yarns or the like between extruded elastomeric inner and outer layers" is disclosed in U.S. Pat. No. 3,586,558, Galloway et al, June/1971.

It has also been possible to use the "Karg" rotary braiding machines for the sequential manufacture of industrial hose products. An inner layer of braided strands is applied to a flexible core element during a "first pass" through a machine. The intermediate product is led from the capstan to suitable storage reels. After a suitable quantity of the intermediate product has been accumulated, the storage reels are positioned as supply reels and the outer braided strand layer is applied during a "second pass" through a machine.

It has now been found that an operable system to control the continuous process covering of a flexible core with multiple-braided strands of reinforcing material need not be complex, may be relatively inexpensive to install, operate and maintain, and will satisfactorily perform to produce large quantities of products with different braid angle and design specifications at a lowered direct labor cost with a reasonable capital investement.

SUMMARY OF THE INVENTION

The object of the invention is to provide an improved system and components thereof to control the covering of a core element with strands of reinforcing material by rotary braiding on tandem or adjacent machines.

It is further object of the invention to provide an improved system and components thereof for controlling the operating speeds of at least two machines, located in tandem or an adjacent arrangement, for covering a moving flexible core element with multiple-layers of reinforcing strands in a process of continuous manufacture.

The present invention was specifically conceived to control the operation of tandem machines having a rotating braiding mechanism and a revolving capstan drum for moving a flexible core element. A specific object is to provide for these machines a control system which is not complex, which is relatively inexpensive to install, operate and maintain, and which will satisfactorily perform to produce large quantities of products with different braid angle and design specifications.

These and other objects of the invention, and further advantages thereof, will be apparent in view of the description of the components thereof and the various operating modes as set forth below.

In general, the invention relates to controlling the operating speeds of tandem machines for covering a moving flexible core element with multiple-layers of reinforcing strands in a process of continuous manufacture.

According to the invention, an operator of the machines is provided with components to establish and define a chorded festoon having vertically aligned upper and lower parameters and extending laterally between first and second machines. A "festoon" is a gravity influenced hanging loop of a product being moved from a first point to a second point during a manufacturing operation. A "chorded festoon" is a mechanically influenced loop of the core element with a first layer of reinforcing strands thereon during lateral movement from a first machine to a second machine. As used herein, the phrases "parameters of" or "vertically aligned upper and lower parameters of" a chorded festoon shall mean two sets or pairs of imaginary or projected linear and intersecting chords; an upper limit and a lower limit. Each pair of projected chords originate at a common point on the first machine and terminate at a common point relative to the second machine. Each pair of projected chords will intersect in an area substantially midway between the first and second machines. The width or height of the chorded festoon will be greatest at these two, upper and lower, projected intersections.

The invention further provides the operator with components to determine and define a vertically oriented zone of operational tolerance within the upper and lower parameters of the chorded festoon and in an area substantially midway between the first and second machines; between the intersections of the upper and lower projected chords. The width or height of the zone of operational tolerance will be dictated by or take into consideration the braid angle and design specification of the product being manufactured.

The invention further provides the operator with components for continuously monitoring the position of a core element with a first layer of reinforcing strands thereon, during lateral movement from the first machine toward the second machine, at any point within the parameters of or between the ends of the chorded festoon.

Still further, the invention provides the operator with components for detecting any position of the laterally moving core element which is changing or has changed within the zone of operational tolerance.

Finally, the invention provides components which will function automatically, without operator intervention, to regulate the operating speed of one machine to correspond with the operating speed of the other machine to return the laterally moving core element from a detected changed position to another position, a preselected or "normal" position, within the zone operational tolerance.

Also the invention provides the operator with components which will also function automatically to stop or halt the operation of both machines when any position of the moving core element is changing to exceed, be beyond, or be outside of either parameter of the chorded festoon.

The disclosed embodiment relates to the control of tandem braiding machines to cover a flexible core element with layers of braided reinforcing strands during successive passes. Each machine has a powered rotating braiding mechanism and a powered capstan drum for moving the core element through the braiding mechanism. Practice of the invention of this embodiment requires powering the braiding mechanism and the capstan drum of each machine from single variable speed drive motor and proportionally controlling the power output from each drive motor to determine a specific braid angle for each layer of reinforcing strands.

The disclosed embodiment relates specifically to the control of tandem rotary braiding machines for continuous manufacture of a product with design specifications requiring that first and second strand layers have a different braid angle. If the first machine covers the core element with strands having a relatively flat braid angle and the second machine covers the flat braid with strands having a relatively steep braid angle, the system regulates the operating speed of the second machine drive motor while maintaining a constant operating speed for the first machine drive motor. If the first machine covering is to have a steep braid angle and the second machine covering is to have a flat braid angle, the operating speed of the first machine drive motor is regulated and the operating speed of the second machine drive motor is maintained constant. In either mode, regulation of one drive motor will return the moving core element to the preselected position within the zone of operational tolerance.

THE DRAWINGS

DETAILED DESCRIPTION OF THE INVENTION

Figure 1:
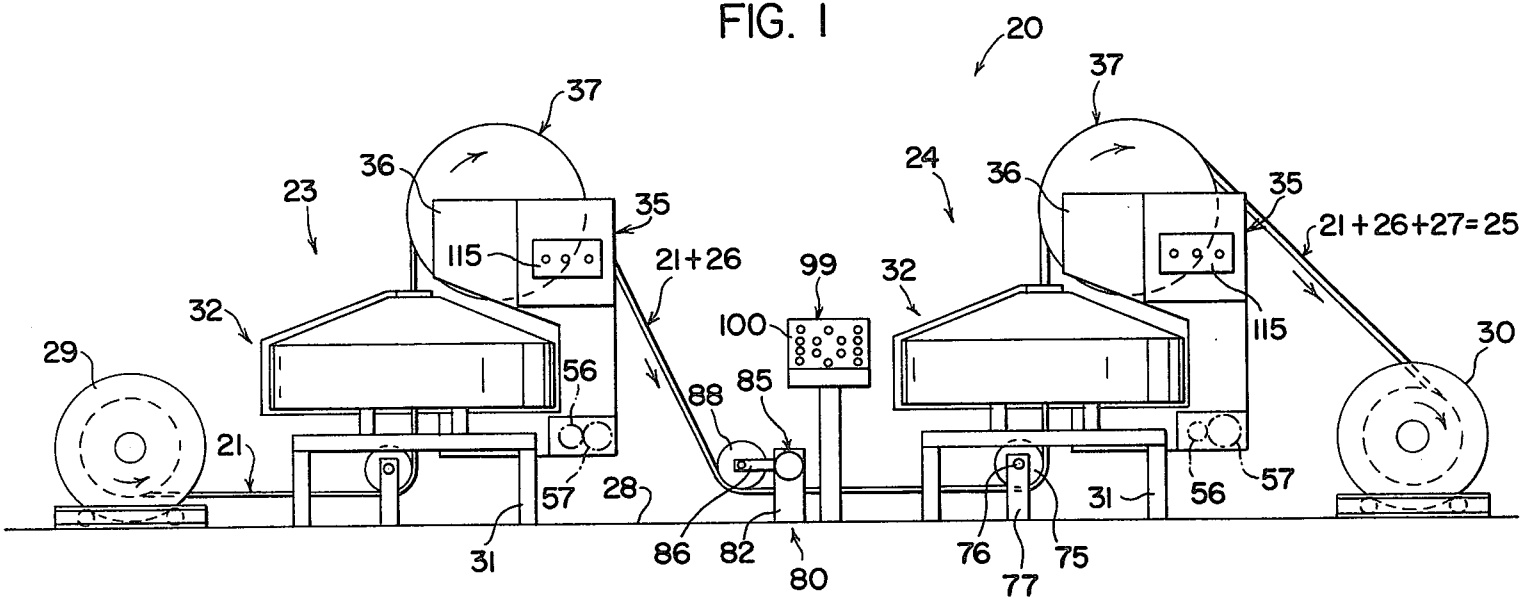
FIG. 1 is an elevational view of tandem braiding machines to cover a flexible core element with layers of braided reinforcing strands during successive passes through the braiding mechanisms of the machines and a control system and components thereof according to the invention.

A system according to the invention will be referred to generally by the numeral 20. The various components of a system 20, in the disclosed embodiment, will be identified by specific reference numerals.

As shown, the system 20 and components thereof control the covering of a core element 21 with strands of reinforcing material 22 by rotary braiding on tandem or adjacent machines; a first machine 23 and a second machine 24.

Figure 7:
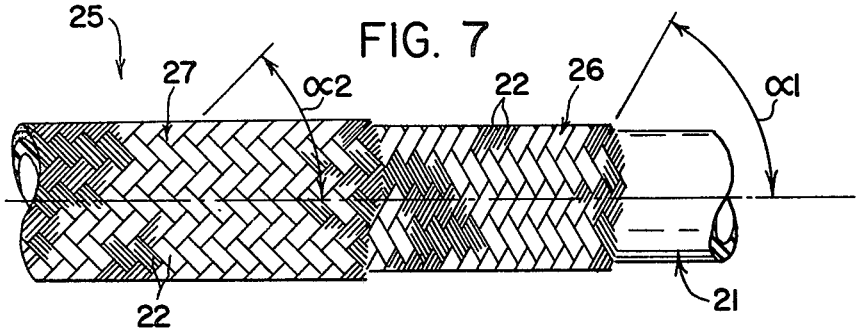
FIG. 7 is a plan view of an industrial hose product, broken away to show a flexible core element, an inner layer of strands having a relatively flat braid angle and an outer layer of strands having a relatively steep braid angle.

A representative or typical product which could be manufactured in a continuous process according to the invention, a product generically called "industrial hose," is disclosed in FIG. 7. The product shown, referred to generally by the numeral 25, has a flexible core element 21 serving during end use as a conduit for transmission of hydraulic fluids under high pressure. The core element 21 is reinforced, for end use, by double-braided strands 22. The inner layer 26 of strands 22 has a relatively flat braid angle ($\alpha^1$). The outer layer 27 of strands 22 has a relatively steep braid angle ($\alpha^2$).

As used herein, the phrase "core element 21" shall mean the coaxial structure around which the strands 22 are laid. The core element 21 is called "flexible" to distinguish from the steel pole or rigid mandrel of the prior art "Ostermann" equipment.

As used herein, the phrase "strands of reinforcing material 22" shall mean any small or fine diameter material capable of being stored on spools and intended for tensioned interlacing, weaving, spiralling or braiding as to each other or around a core member. The strands 22 may be a synthetic or natural fibre, or thread, or of metallic origin. Or, the strand layers 26 and 27 may have different compositions.

Referring to FIG. 1, the operating environment for the system 20 and the tandem rotary braiding machines 23 and 24 requires an area of factory floor 28 adequate for the placement of conventional core element supply reels 29 and product take-up reels 30. The machine 23 and 24 may be placed "in-line," as shown; or at angles one to the other, so long as there is space in between for components of the system 20.

Figure 2:
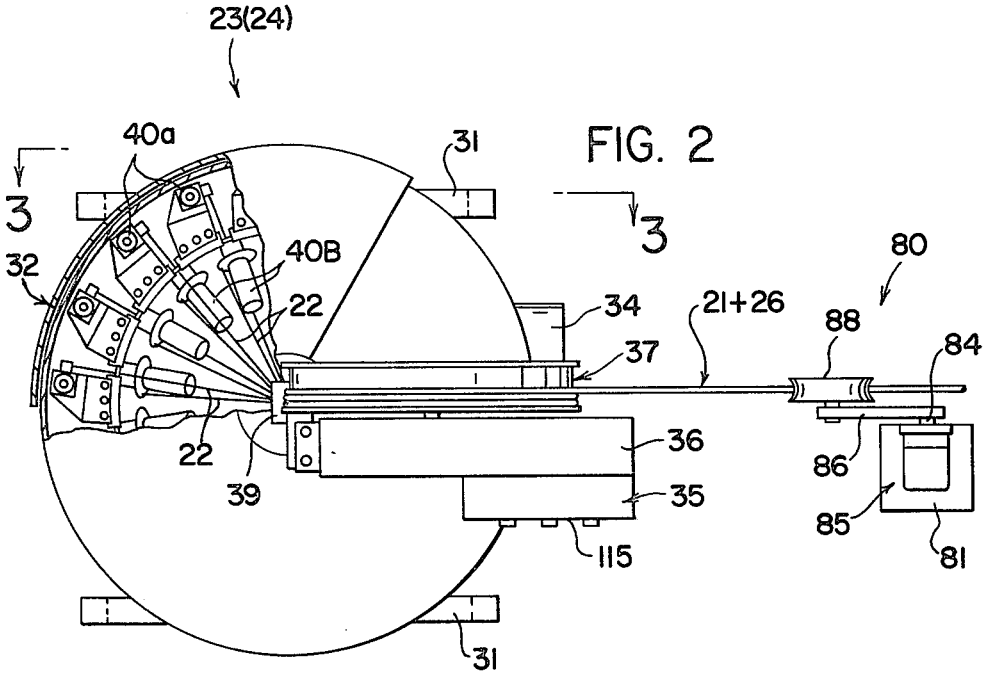
FIG. 2 is a plan view of a rotary braiding machine, partially broken away, showing sets of outer and inner spools of a braiding mechanism and a revolving capstan drum for moving a flexible core element.
Figure 3:
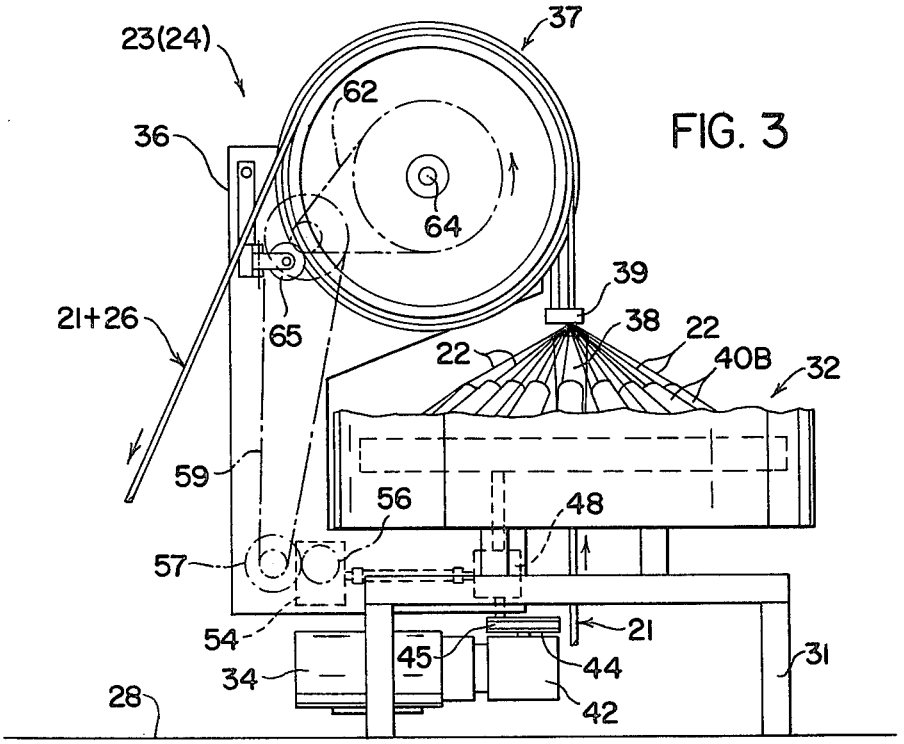
FIG. 3 is a rear elevation of a rotary braiding machine, taken substantially as indicated on line 3—3 of FIG. 2, including schematic details of a spool holder drive mechanism and a capstan drive mechanism powered by a single variable speed drive motor.

Mechanical and operational features of a machine 23 (or 24) are shown in FIGS. 2 and 3. The braiding machine 23 (or 24) has a structural frame with a support member 31 for mounting on the floor 28. A machine 23 (or 24) includes a braiding mechanism indicated generally at 32, a variable speed drive motor 34, a contol box 35 (also, see FIG. 10A), a capstan support housing 36, a revolving capstan drum indicated generally at 37, an interior braiding point retainer 38, and an exterior braiding point retainer 39. The "work center" of the machine 23 (or 24) is in the area between the retainers 38 and 39.

Referring to FIG. 2, the braiding mechanism 32 includes a spool holder drive mechanism (not shown in detail) which actuates relative movement of a set of outer spools 40A and a set of inner spools 40B along circular paths in opposite directions. A reinforcing strand 22 from each spool 40A and 40B is let off toward the "work center" for braiding as to each other and around the moving core element 21 introduced coaxially of the braiding mechanism 32.

Each machine 23 or 24 preferably will have a proportional control means, referred to generally by the numeral 41, to synchronize the revolving movement of the capstan drum 37 (providing a lineal movement of the core element 21) and the circular movement of the sets of outer and inner spools 40A and 40B (providing a wrapping movement of the strands 22). The power input to a proportional control means 41 is from the drive motor 34 mounted on a machine frame 31.

Figure 4:
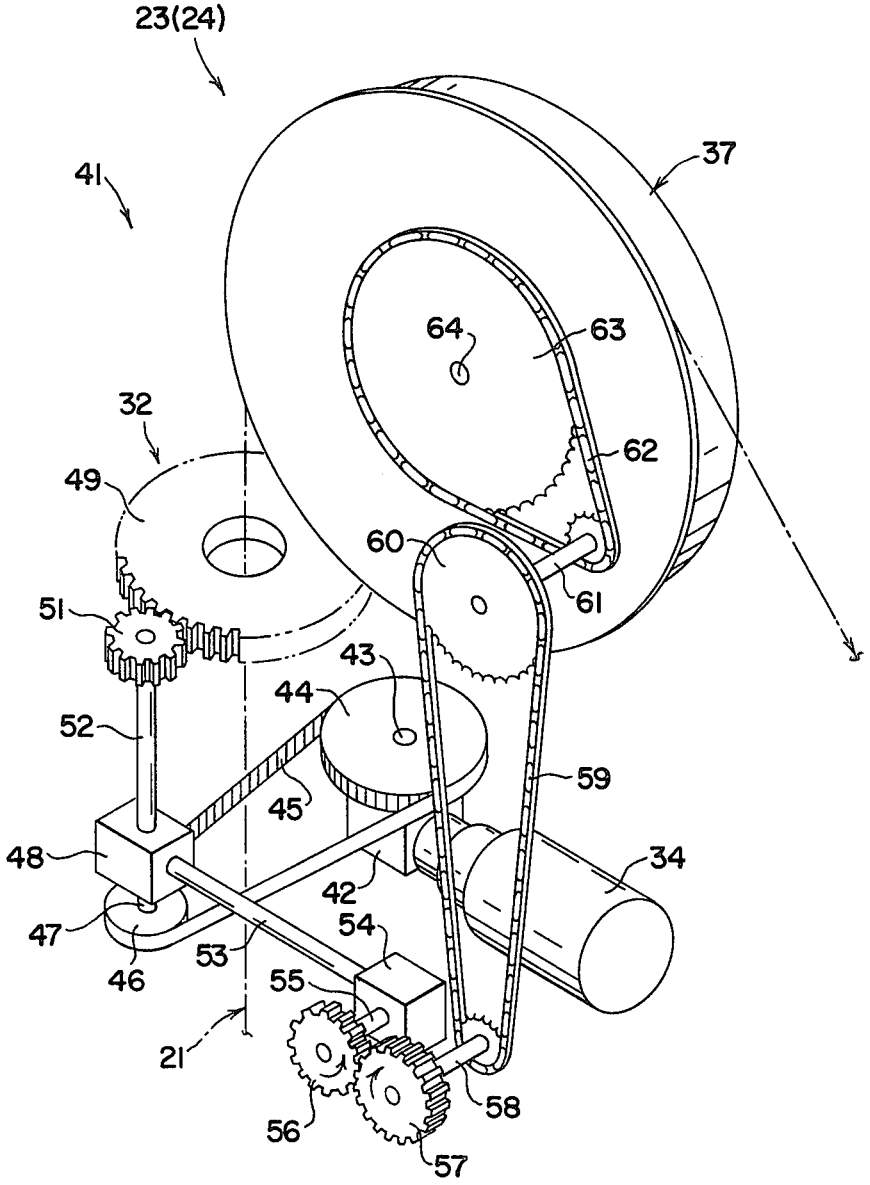
FIG. 4 is a perspective view of braiding machine components including an adjustable proportional control means, with a power input from a single drive motor, to synchronize the revolving movement of a capstan drum and the circular movement of the spool holder drive mechanism to determine a specific braid angle for the strand covering on a flexible core element.

Referring to FIG. 4, the drive motor 34 is coupled to a right angle gear box 42 with a shaft 43 mounting a cog pulley 44. The larger diameter pulley 44 is connected by a cog belt 45 to a smaller diameter cog pulley 46. The cog pulley 46 is carried on the power input shaft 47 of an epicyclic gear unit 48. A spool holder drive mechanism will include a drive gear 49 meshing with a smaller gear 51 carried on the end of a power shaft 52 originating in the gear unit 48.

(Elements 49, 51 and 52, just described, are identified by like numerals in the description and drawings of U.S. Pat. No. 3,756,117, DeYoung, September/1973, for a Spool Holder Drive Mechanism.)

The drive mechanism for the capstan drum 37 includes a power shaft 53 originating in the gear unit 48 and terminating in a right angle gear box 54 having an output shaft 55. The output shaft 55 carries a primary gear 56 which continuously meshes with a secondary gear 57. (Further reference to the function of gears 56 and 57 will follow.) Gear 57 is carried on a sprocket shaft 58 engaging a drive chain 59 extending upwardly and around a sprocket 60. The sprocket 60 is carried by a sprocket shaft 61 journaled in the capstan housing (36). Sprocket shaft 61 engages a drive chain 62 extending laterally and around a drive sprocket 63 mounted on a drive shaft 64 carrying the capstan drum 37.

A proportional control means 41, including elements 42–49 and 51–64 as described, will generally function to determine a specific braid angle for a covering of strands 22 on a core element 21 at any operating speed of the drive motor 34, from minimum speed to maximum speed. The primary and secondary gears, 56 and 57, in the power train of the capstan drive mechanism are specifically intended to readily provide for a change in braid angle design. An increase in the effective diameter of gear 56 relative to the diameter of gear 57 will increase the rate of lineal movement of the core element 21 relative to the rate of wrapping movement of the strands 22 around the core element 21 and the product 25 will have strand layers 25 (or 26) with a steeper (lower) braid angle. A relative decrease in the size ratio of gear 56 to gear 57 will provide a product 25 with strand layers 25 (or 26) having a flatter (higher) braid angle.

Referring to FIG. 3, a machine 23 or 24 may use a roller 65 to maintain multiple loops of the core element 21 in symmetric frictional engagement with the capstan drum 37.

Figure 5:
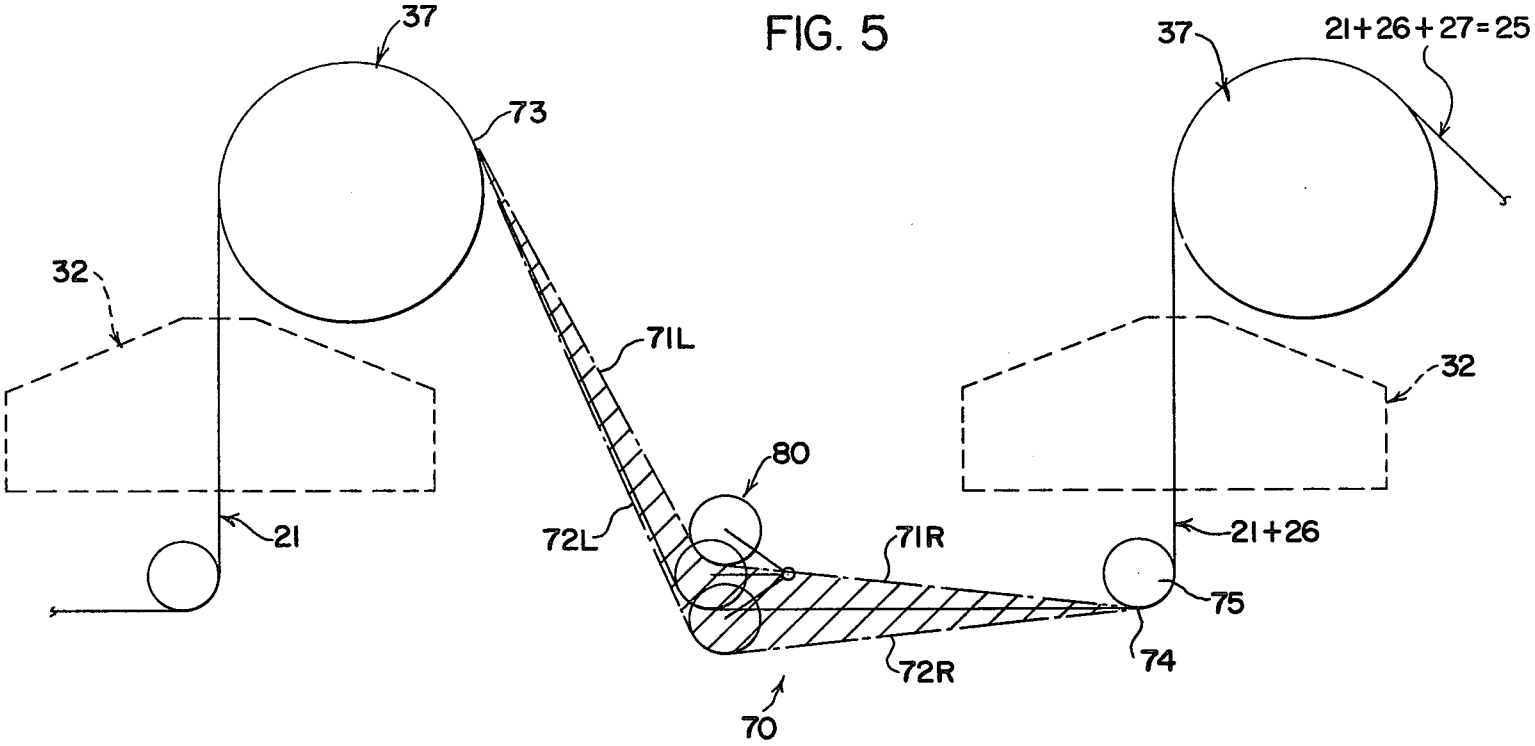
FIG. 5 is a schematic elevation showing the parameters of a chorded festoon extending laterally between first and second rotary braiding machines.

Effective control by the system 20 of the operating speeds of machines 23 and 24 to manufacture a product 25 is made possible by a concept of the invention whereby the parameters of a chorded festoon extend laterally between the machines. This concept of chorded festoon control of a moving flexible core element 21 during covering with layers of strands 22 is best shown in FIG. 5.

The chorded festoon, referred to generally by the numeral 70, comprises two sets or pairs of imaginary or projected linear and intersection chords. The upper parameter, or upper limit, comprises chain lines 71L and 71R. The lower parameter, or lower limit, comprises chain lines 72L and 72R. The linear factors of the lines 71 and 72 are to be regarded and considered as vertically aligned. Chords 71L and 72L originate at a point 73 on the surface of the periphery of a revolving capstan drum 37. Chords 71R and 72R terminate at a point 74 on the surface of a guide roller 75.

Referring also to FIG. 1, a guide roller 75 is a freely rotating idler roll with a shaft 76 carried by a base or stanchion 77 mounted on the floor 28 beneath machine 24. The base 77 is positioned so as to define the exit end of the chorded festoon 70 and also to direct a core element 21 with a strand layer 26 thereon coaxially into the second pass braiding mechanism 32.

Referring again to FIG. 5, each pair of projected chords, 71L and 71R and 72L and 72R, do intersect in an area substantially midway between the machines 23 and 24. The width or height of the chorded festoon 70, as indicated by the slanted lines, is greatest at these two, upper and lower, projected intersections of chords 71L and 71R and 72L and 72R. The chorded festoon 70 is achieved by the use of a speed controller unit, referred to generally by the numeral 80.

Figure 6:
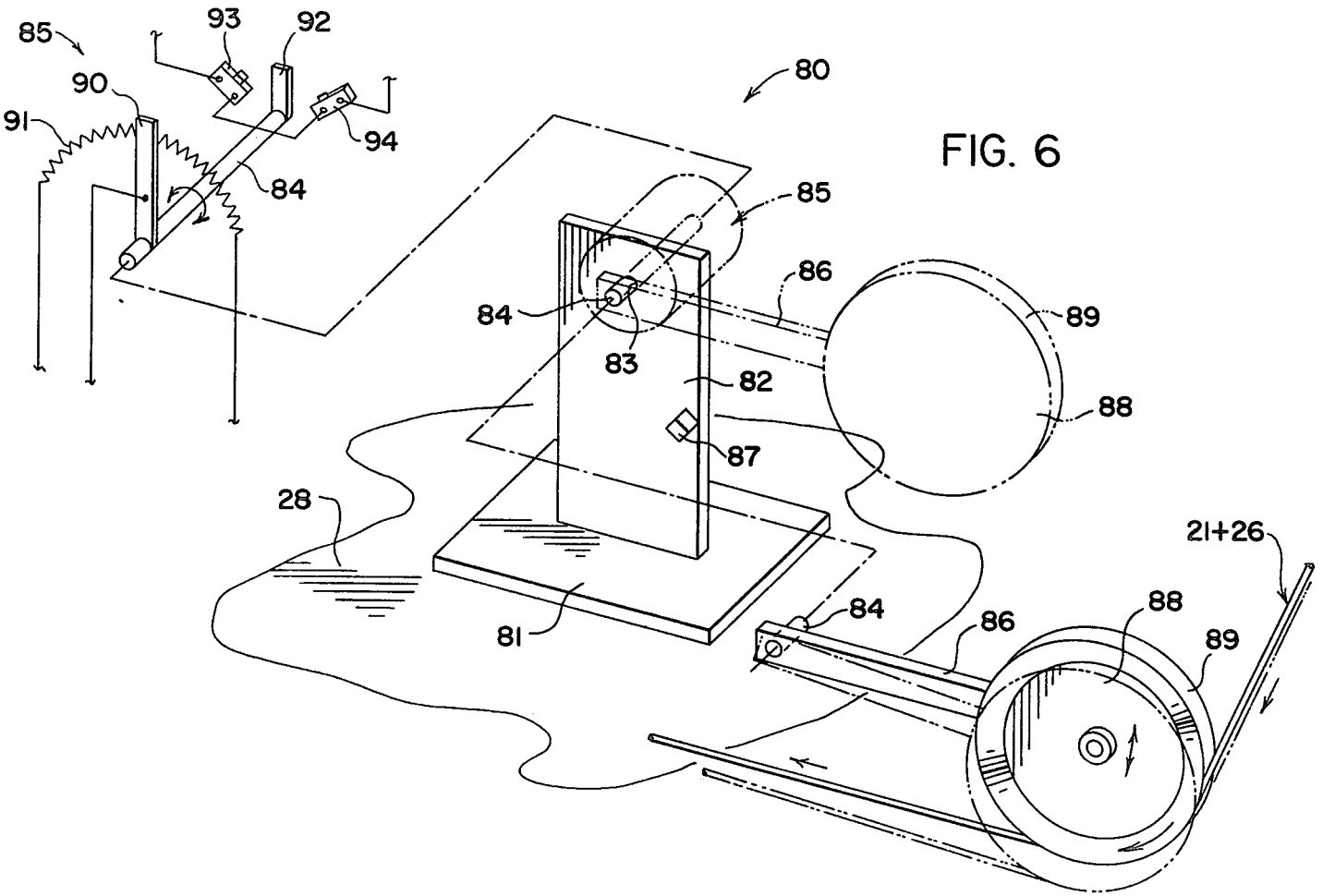
FIG. 6 is an exploded perspective view of a speed controller system component to be positioned substantially midway between the first and second rotary braiding machines.

The components of a speed controller unit 80 according to the invention are best shown in FIG. 6. A base member or plate 81 is adapted for mounting on the floor 28 substantially midway between the machines 23 and 24. The base member 81 carries a vertically oriented stanchion 82 extending upwardly to a suitable height. The stanchion 82 has a transverse bore 83 therethrough to receive the horizontally oriented and freely rotating control shaft 84 of a core element position indicator potentiometer, referred to generally by the numeral 85 (DCR1), secured to the front face of the stanchion 82.

The end of the control shaft 84 extending through the stanchion 82 carries the base of a core element position monitoring and change detecting elongated wand or slender projecting rod 86. The arcuate movement path of the wand 86 around the axis provided by shaft 84 has a downward "at rest" position, as provided by an abutment stop element 87 on the rear face of the stanchion 82.

The arcuately moving projecting end of the wand 86 mounts a core element position monitoring means or roller 88. A roller 88 is mounted to freely rotate, with minimal frictional drag, when the periphery 89 thereof is in contact with a laterally moving core element 21 with a strand layer 26 thereon. A roller 88 also has a mass or weight such as to mechanically influence the laterally moving core element to form a chorded festoon.

The electrical functions of the potentiometer 85 of the speed controller unit 80 are described in detail below with reference to FIG. 11B. Referring to FIG. 6 (upper left hand corner), the shaft 84 carries a wiper arm 90 in movable engagement with the incrementally spaced contact points of the resistance circuitry 91. The shaft 84 also carries a cam lug 92 for selective actuation of either of a pair of normally closed limit switches 93 and 94; upper and lower limit (DSHLS and DSLLS).

The electrical components of a system 20 include a master control console 99 positioned on the floor 28 so that the operator can see both machines, 23 and 24, and the current physical position of the wand 86 and roller 88 of the speed controller unit 80.

Figure 10:
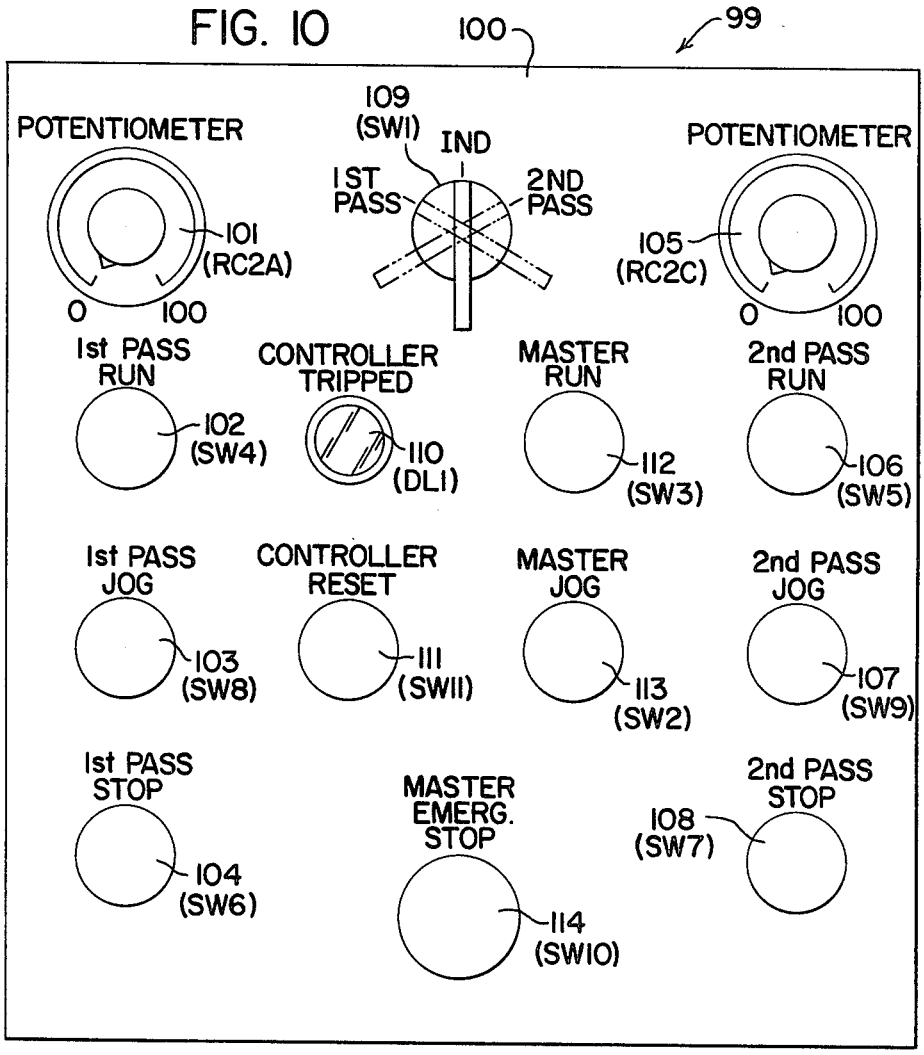
FIG. 10 is a plan view of the panel of a master control console.

The system 20 provides the operator of tandem rotary braiding machines 23 and 24 with a master control console 99 having a panel 100, as shown by FIG. 10. The left hand portion of the master control panel 100 may have: a potentiometer 101 for determining the operating speed of the drive motor of the first machine 23; a "run" button 102 for starting machine 23; a "jog" button 103 for selective use (as during leading of a core element 21 through the braiding mechanism and wrapping around the capstan drum 37 of machine 23); and a "stop" button 104 for machine 23.

Similarly, the right hand portion of the master control panel 100 will have: a potentiometer 105 for determining the operating speed of the drive motor for the second machine 24; a "run" button 106 for machine 24; a "jog" button 107; and, a "stop" button 108 for machine 24.

The midportion of the master control panel 100 has a three function switch 109. The left hand function or "first pass" is used when machine 23 is "master" and machine 24 is "slave"; when the braid angle of strand layer 26 is flatter than the braid angle of strand layer 27. The right hand function or "second pass" is used when machine 24 is "master" and machine 23 is "slave"; when the braid angle of strand layer 27 is flatter than the braid angle of strand layer 26. The middle function of switch 109 is used when the operator is individually operating machine 23 and 24.

Below switch 109, the master control panel has: an indicating light 110, "controller tripped" (showing the speed controller unit 80 as inoperative); a button 111 "controller reset" (to reactivate unit 80); a "master run" button 112 for starting the drive motors of both machines, 23 and 24; a "master jog" button 113 controlling both machines; and a "master emergency stop" button 114 for everything being controlled by the system 20.

Figure 10A:
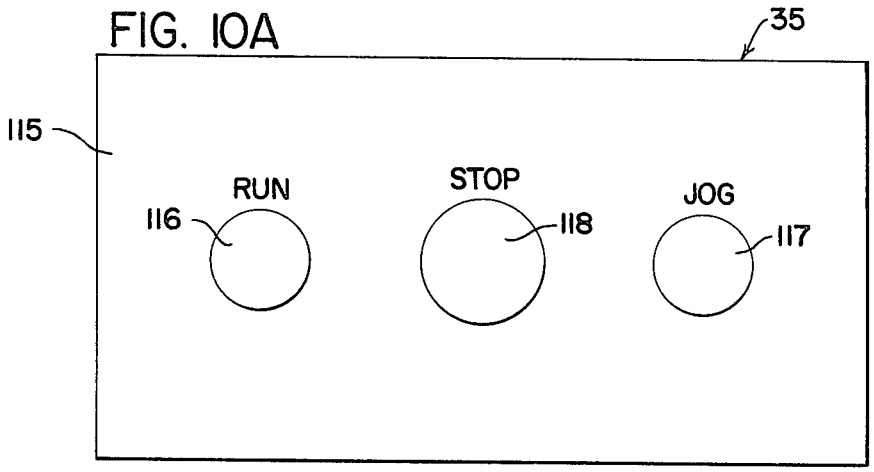
FIG. 10A is a plan view of the panel of a control box on a rotary braiding machine; and, FIGS. 11A, 11B and 11C are fragmentary wiring diagrams to be considered in conjunction with each other and the control panels of FIGS. 10 and 10A, as well as individually.

The system 20 also permits the operator to individually operate either machine 23 or 24 from the panel 115 of a control box 35. As shown by FIG. 10A, the machine control panel 115 has: a "run" button 116; a "jog" button 117; and, a "stop button" 118.

Figure 11A:
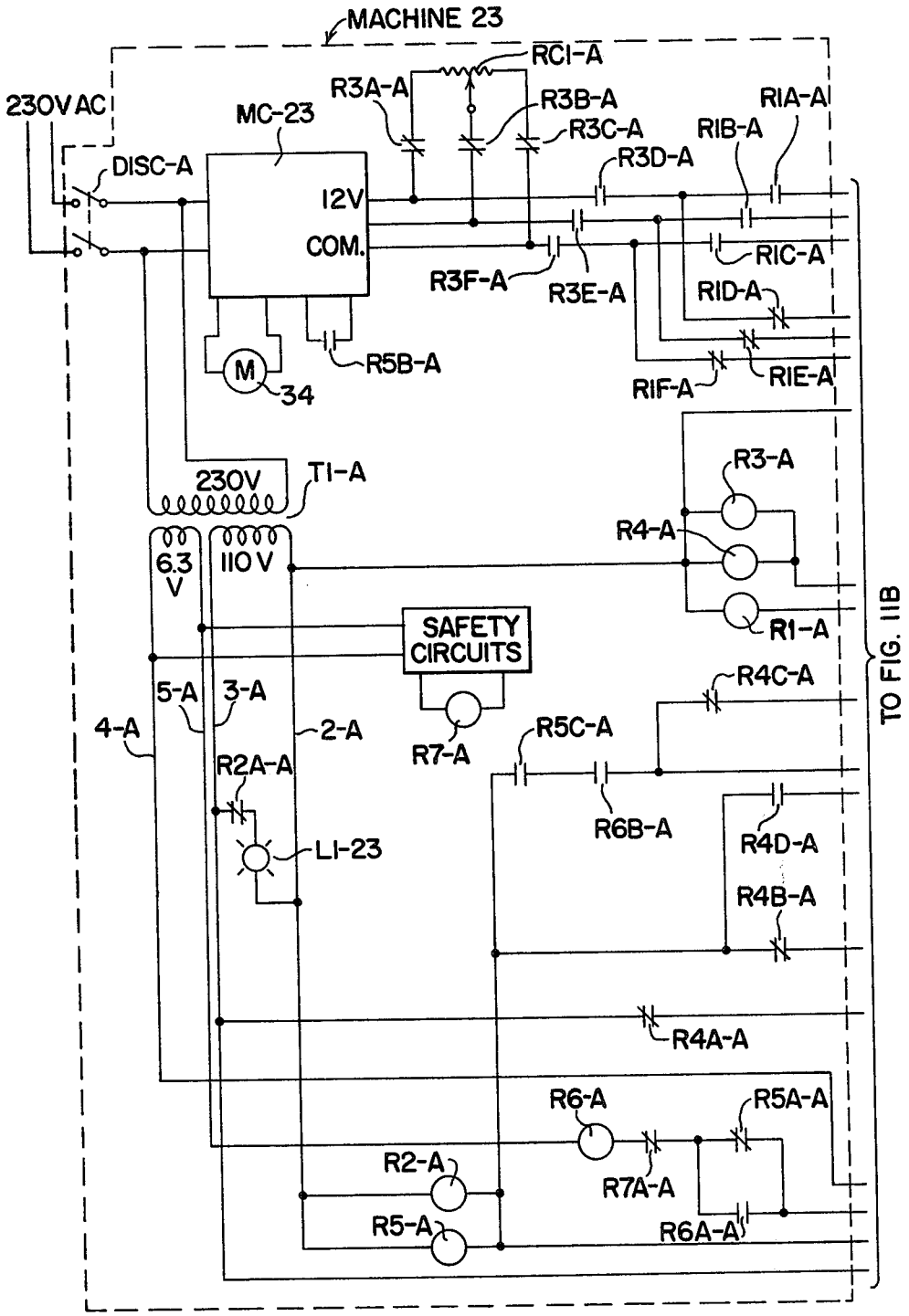
Figure 11B:
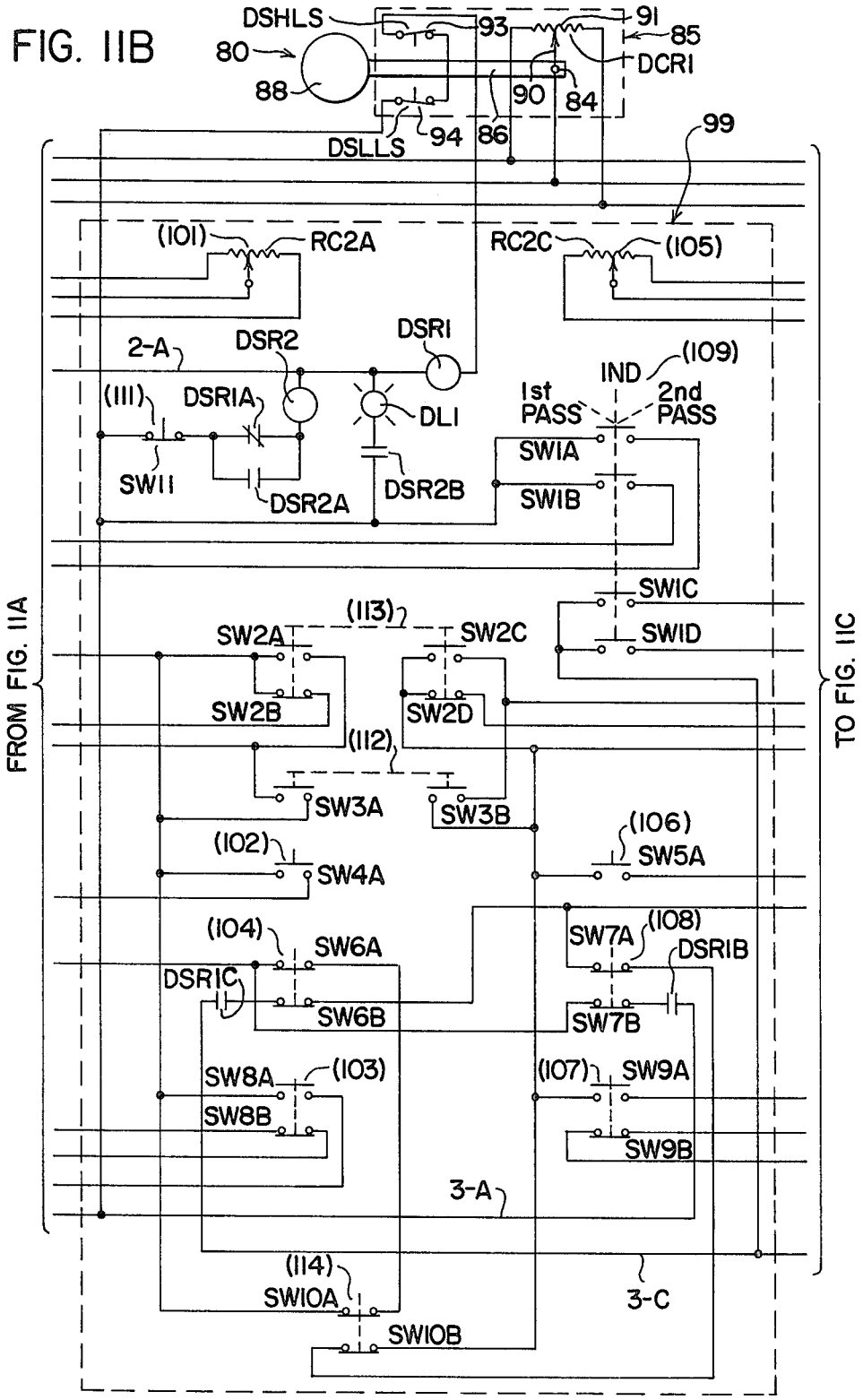
Figure 11C:
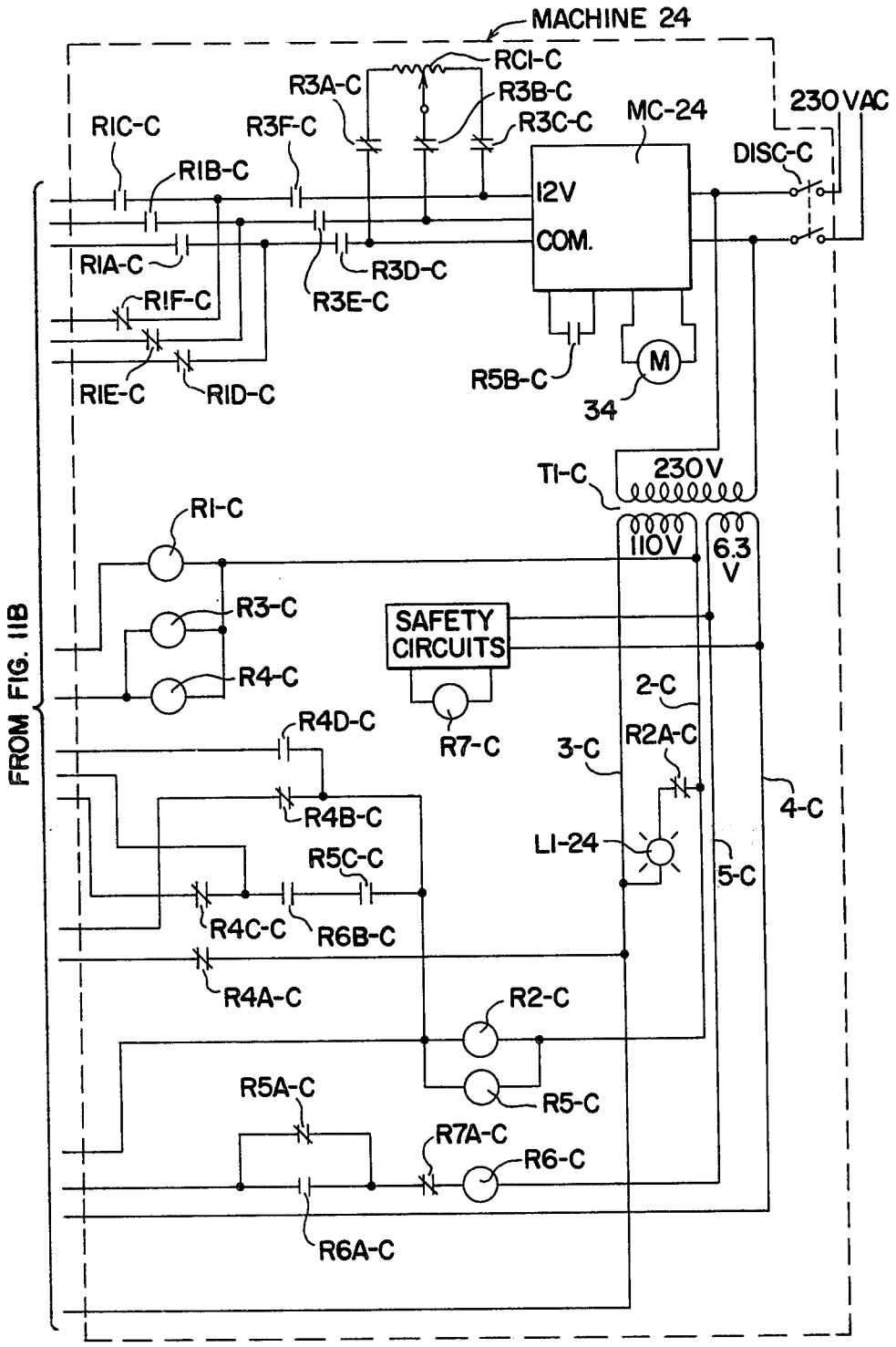

The elements of the circuitry in the system 20 controlled from the master control console 99 are shown by the wiring diagrams of FIGS. 11A, 11B and 11C, which are to be considered in conjunction with each other as well as individually.

FIG. 11A shows electrical components of the system 20 which could be physically installed in the control box 35 for or on the first machine 23. FIG. 11C shows electrical components of the system 20 which could be physically installed in the control box 35 for or on the second machine 24. The components in FIGS. 11A and 11C are suitably interconnected with the electrical components in FIG. 11B, preferably installed on the master console 99 beneath the control panel 100. FIG. 11B also shows the operative relation of the mechanical and electrical components of the speed controller unit 80 to the electrical components of the system 20.

Referring to FIG. 11A, power is supplied to the first machine 23 by manual closing of a master power switch DISC-A. Power is thereby applied to the motor control circuit MC-23 and also to a transformer T1-A. The transformer T1-A provides 110 V current on lines 2-A and 3-A, and 6.3 V current on lines 4-A and 5-A. The 6.3 V current energizes relay R6-A through contacts R7-A and R5A-A (and, also SW8B on FIG. 11B). The 6.3 V current also closes contacts R6A-A and R6B-A forming a part of a holding circuit for operation of the first machine drive motor 34.

Referring to FIG. 11C, power is supplied to the second machine 24 by manual closing of a master power switch DISC-C. Power is thereby applied to the motor control circuit MC-24 and also to a transformer T1-C. The transformer T1-C provides 110 V current on lines 2-C and 3-C, and 6.3 V current on lines 4-C and 5-C. The 6.3 V current energizes relay R6-C through contacts R7A-C and R5A-C (and, also SW9B on FIG. 11B). The 6.3 V current also closes contacts R6A-C and R6B-C forming a part of a holding circuit for operation of the second machine drive motor 34.

Individual Operation of Each Machine, 23 or 24

Referring to FIGS. 10, 11A and 11B, the operator may start the first machine 23 by momentarily depressing the "run" button 102 (SW4) to close contact SW4A. The closing of contact SW4A provides 110 V current from line 3-A to relays R2-A and R5-A through contacts R4A-A, SW6A, SW10A, SW4A and R4B-A. The other side of relays R2-A and R5-A are connected to line 2-A. Energizing relay R2-A opens contact R2A-A, which removes power from a suitably located safety or "motor off" indicator light L1-23. Energizing relay R5-A opens contact R5A-A and closes contacts R5B-A and R5C-A. The closing of contact R5B-A actuates the motor control circuit MC-23 to start operation of the first machine drive motor 34 (M). The motor 34 will drive the gear box 42 at a speed determined by the adjustable setting of potentiometer RC1-A through relay contacts R3A-A, R3B-A, and R3C-A.

The operator may stop the first machine 23 by momentarily depressing the "stop" button 104 (SW6) and thereby de-energizing relay R5-A opening contact R5B-A in the motor control circuit, and opening contact R5C-A forming a part of the run holding circuit for operating the drive motor 34.

A machine 23 will preferably have a safety circuit for indicating when a spool 40A or 40B has been depleted of a reinforcing strand 22. When such a safety circuit is tripped, a relay R7-A is energized opening contact R7A-A to de-energize relay R6-A. A de-energization of relay R6-A opens contact R6B-A in the run holding circuit and de-energizes relay R5-A.

The operator may jog the first machine 23 by depressing the "jog" button 103 (SW8) and thereby providing current for relays R2-A and R5-A through contacts R4A-A, SW6A, SW10A, and SW8A. When button 103 is continually depressed, contact SW8B is opened removing power from relay R6-A which opens contact R6B-A in the run holding circuit. The first machine 23 will run only so long as button 103 (SW8) is depressed.

Referring to FIGS. 10, 11B and 11C, the operator may start the second machine 24 by momentarily depressing the "run" button 106 (SW5) to close contact SW5A. The closing of contact SW5A provides 110 V current from line 3-C to relays R2-C and R5-C through contacts R4A-C, SW7A, SW10B, SW5A, and R4B-C. The other side of relays R2-C and R5-C are connected to line 2-C. Energizing relay R2-C opens contact R2A-C, which removes power from a suitably located safety or "motor off" indicator light L1-24. Energizing relay R5-C opens contact R5A-C and closes contacts R5B-C and R5C-C. The closing of contact R5B-C actuates the motor control circuit MC-24 to start operation of the second machine drive motor 34 (M). The motor 34 will drive the gear box 42 at a speed determined by the adjustable setting of potentiometer RC1-C through relay contacts R3A-C, R3B-C, and R3C-C.

The operator may stop the second machine 24 by momentarily depressing the "stop" button 108 (SW7) and thereby de-energizing relay R5-C opening contact R5B-C in the motor control circuit, and opening contact R5C-C forming a part of the run holding circuit for operating the drive motor 34.

A machine 24 will preferably have a safety circuit for indicating when a spool 40A or 40B has been depleted of a reinforcing strand 22. When such a safety circuit is tripped, a relay R7-C is energized opening contact R7A-C to de-energize relay R6-C. A de-energization of relay R6-C opens contact R6B-C in the run holding circuit and de-energizes relay R5-C.

The operator may jog the second machine 24 by depressing the "jog" button 107 (SW9) and thereby providing current for relays R2-C and R5-C through contacts R4A-C, SW7A, SW10B, and SW9A. When button 107 is continually depressed, contact SW9B is opened removing power from relay R6-C which opens contact R6B-C in the run holding circuit. The second machine will run only so long as the button 107 (SW9) is depressed.

First Tandem Mode of Operation When Machine 23 is "Master" and Machine 24 is "Slave"

This mode of operation is preferably used when the first machine 23 covers the moving core element with a layer of strands 26 having a relatively flat braid angle and the second machine 24 covers the flat braid with a layer of strands 27 having a relatively steep braid angle.

Referring to FIGS. 11A and 11C, power is supplied to both machines, 23 and 24, by manual closing of the master power switches, DISC-A and DISC-C. Power is thereby applied to the motor control circuits MC-23 and MC-24 and also to transformers T1-A and T1-C. The transformer T1-A provides 110 V current on lines 2-A and 3-A, and 6.3 V current on lines 4-A and 5-A. The transformer T1-C provides 110 V current on lines 2-C and 3-C, and 6.3 V current on lines 4-C and 5-C.

Referring also to FIGS. 10 and 11B, with switch 109 (SW1) in the left hand position for "first pass," contacts SW1B, SW1C and SW1D will be closed. The 110 V current from line 3-A provides power for relays R3-A and R4-A through contact SW1B. The 110 V current from line 3-C provides power for relay R1-C through contact SW1C, and power for relays R3-C and R4-C through contact SW1D. When relay R3-A is energized, contacts R3A-A, R3B-A and R3C-A are opened to isolate the potentiometer RC1-A, for the first machine 23, from the motor control circuit MC-23. Also, when relay R3-A is energized, contacts R3D-A, R3E-A, and R3F-A are closed providing a circuit path through closed contacts R1D-A, R1E-A and R1F-A for the potentiometer 101 (RC2A) to the motor control circuit MC-23. When relays R1-C and R3-C are energized, contacts R3A-C, R3B-C, R3C-C, R1D-C, R1E-C and R1F-C are opened to isolate both the potentiometer RC1-C, for the second machine 24, and the potentiometer 105 (RC2C) from the motor control circuit MC-24. Also, when relays R1-C and R3-C are energized, contacts R1A-C, R1B-C, R1C-C, R3D-C, R3E-C, and R3F-C are closed providing a circuit path for the potentiometer 85 (DCR1) to the motor control circuit MC-24. The contacts R1A-A,R1B-A, and R1C-A remain open during operation of the machines, 23 and 24, in this mode. The system 20 will now be ready to enable the operator to select the base operating speed for the first machine 23.

The base operating speed of a rotary braiding machine is a variable factor; a value which is preferably chosen in a range between ten percent (10%) and ninety percent (90%) of the maximum speed as limited by the circular movement of the braiding mechanism 32. The choice of a particular operating speed for a machine 23 or 24 is dictated or determined by the physical properties of the product 25; more specifically, the characteristics of a core element 21 and strands 22.

For example, a core element 21 which is inherently subject to a disproportionate elongation under the tension of a revolving capstan drum 37 will generally be braided at a slower operating speed. Conversely, a relatively non-extensible core element 21 should enable the operator to choose a faster operating speed. Also, a metallic strand 22, having inherent rigidity, would generally be braided at a slower operating speed, as contrasted with a strand 22 of natural or synthetic fibre which could be braided at a faster operating speed. In any event, the system 20 enables the operator to choose an appropriate operating speed for moving the core element 21 to pass through the braiding mechanism 32 of the first machine 23 and to pass through the braiding mechanism 32 of the second machine 24 by concurrent operation of the drive motors 34 of each machine.

Figure 8:
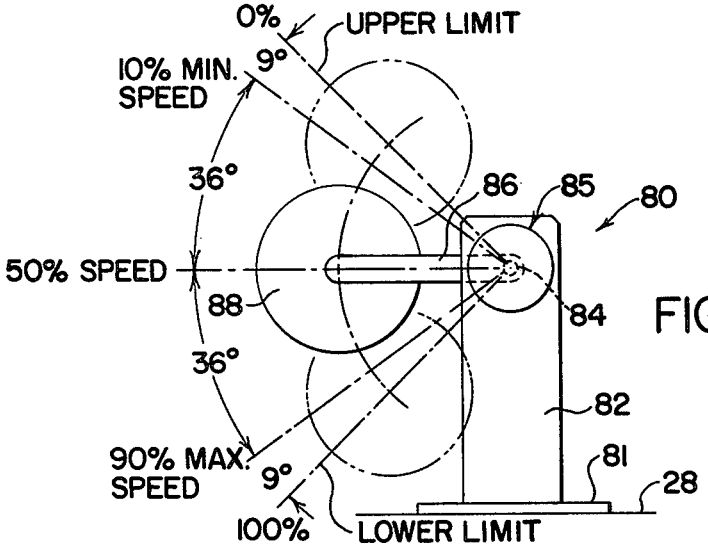
FIG. 8 is a schematic view of a speed controller component according to FIG. 6 being used in an operating mode wherein the first machine covers a moving core element with a layer of strands having a relatively flat braid angle and the second machine covers the flat braid with a layer of strands having a relatively steep braid angle—a first pass master-second pass slave, mode.

FIG. 8 is intended to schematically show operating variables available to the operator in the first pass master-second pass slave mode. The input shaft 84 to the potentiometer 85 (DCR1) is intended to have a 90° total angular travel. At either side, an arc segment of 9° has been dedicated for use in stopping the operation of the drive motors 34 for each machine, 23 and 24. It has been found that an arc segment of 72° for movement of the wand 86 and roller 88 will enable the operator to effectively and accurately control the covering of a core element 21 at any operating speed chosen in the 10% to 90% range.

Referring again to FIGS. 10, 11A and 11B, the operator manually sets the potentiometer 101 (RC2A) to determine the base operating speed of the drive motor of the first machine 23. The roller 88 of the speed controller unit 80 is positioned so that the normally closed limit switches 93 and 94 (DSHLS and DSLLS, respectively) remain in a condition to energize the relay DSR1. The operator starts the machines 23 and 24 in tandem operation by momentarily depressing the "master run" button 112 (SW3).

The closing of contact SW3A provides 110 V current from line 3-A to relays R2-A and R5-A through contacts DSR1B, SW7B, SW6A, SW10A, SW3A, and R4D-A. Energizing relay R2-A opens contact R2A-A, which removes power from a suitably located safety or "motor off" indicator light L1-23. Energizing relay R5-A opens contact R5A-A and closes contacts R5B-A and R5C-A. The closing of contact R5B-A actuates the motor control circuit MC-23 to start operation of the first machine drive motor 34. Relay R5-A is held in an energized condition through contacts DSR1B, SW7B, SW6A, SW10A, SW2B, R6B-A and R5C-A.

Simultaneously, the closing of contact SW3B provides 110 V current from line 3-C to relays R2-C and R5-C through contacts DSR1C, SW6B, SW7A, SW10B, SW3B, and R4D-C. Energizing relay R2-C opens contact R2A-C, which removes power from a suitably located safety or "motor off" indicator light LI-24. Energizing relay R5-C opens contact R5A-C and closes contacts R5B-C and R5C-C. The closing of contact R5B-C actuates the motor control circuit MC-24 to start operation of the second machine drive motor 34. Relay R5-C is held in an energized condition through contacts DSR1C, SW6B, SW7A, SW10B, SW2D, R6B-C and R5C-C.

In this mode, the operating speed and the power output of the drive motor for the first machine 23 is maintained constant, as determined by the operator setting of the potentiometer 101 (RC2A). The operating speed and the power output of the drive motor for the second machine 24 is automatically regulated by the potentiometer 85 of the speed controller unit 80.

Referring again to FIGS. 1, 5, 6 and 8 (and 9), the concurrent operation of the drive motors of each machine, 23 or 24, will move the core element 21 with a strand layer 26 laterally from machine 23 to machine 24. The weight of roller 88 of the speed controller unit 80 will mechanically influence the laterally moving core element to form a chorded festoon. The revolving roller 88 will also function to continuously monitor any position of the moving core element. The wand 86 carrying the roller 88 and connected to the potentiometer shaft 84 will detect any position of the laterally moving core element which is changing. Any rotation of the shaft 84, in either direction, will result in a movement of the potentiometer wiper arm 90 to vary the voltage output of the resistance circuitry 91.

Referring again to FIGS. 11B and 11C, the voltage output of the potentiometer 85 (DCR1) is transmitted to the motor control circuit MC-24. Any downward arcuate movement of the wand 86 and roller 88 will increase the operating speed of the second machine drive motor 34. Any upward arcuate movement of the wand 86 and roller 88 will decrease the operating speed of the second machine drive motor.

The system 20 further provides the operator with components which will function automatically to stop or halt the drive motors 34 of both machines, 23 and 24, when any position of the moving core element is changing to exceed the parameters of the chorded festoon. With reference to FIGS. 5 and 8, the normally closed limit switches 93 and 94, best shown in FIG. 6, are positioned to function at a selected point within a 9° arc segment. Switch 93 defines an upper limit for movement of a core element 21 with a strand layer 26 thereon in proximity to the chords 71L and 71R; as when the operating speed of the second machine 24 is becoming faster than desired. Switch 94 defines a lower limit for the moving core element 21 in proximity to the chords 72L and 72R; as when the operating speed of the second machine 24 is becoming slower than desired.

Referring to FIG. 11B, the opening of either limit switch, 93 or 94 (DSHLS or DSLLS), by contact with the shaft lug 92 of the speed controller unit 80 will de-energize relay DSR1. De-energization of relay DSR1 will open contacts DSR1B and DSR1C in a run hold circuit which will in turn open the relays R5-A and R5-C, stopping the drive motor 34 of each machine, 23 or 24. Opening of either limit switch, 93 or 94, will also energize relay DSR2 and close contacts DSR2A and DSR2B. Closing contact DSR2B will provide power to the "controller tripped" indicating light DL1 (110). After the operator has corrected whatever operating condition created the stoppage, the machines 23 and 24 are restored to operation by depressing the master run switch SW3 (112). The indicator light DL1 (110) can be turned off by depressing the "controller reset" button SW11 (111) to de-energize relay DSR2 and open contact DSR2B).

Second Tandem Mode of Operation When Machine 24 is "Master" and Machine 23 is "Slave"

This mode of operation is preferably used when the first machine 23 covers the moving core element 21 with a layer of strands 26 having a relatively steep braid angle and the second machine 24 covers the steep braid with a layer of strands 27 having a relatively flat braid angle.

In this mode, both machines, 23 and 24, are powered as described above for the first mode.

Referring to FIGS. 10, 11A, 11B and 11C, with switch 109 (SW1) in the right hand position for "second pass," contacts SW1A, SW1B and SW1D will be closed. The 110 V current from line 3-A provides power for relay R1-A through contact SW1A, and power for relays R3-A and R4-A through contact SW1B. The 110 V current from line 3-C provides power for relays R3-C and R4-C through contact SW1D. When relay R3-C is energized, contacts R3A-C, R3B-C and R3C-C are opened to isolate the potentiometer RC1-C, for the second machine 24, from the motor control circuit MC-24. Also, when relay R3-C is energized, contacts R3D-C, R3E-C and R3F-C are closed providing a circuit path through closed contacts R1D-C, R1E-C, and R1F-C for the potentiometer 105 (RC2C) to the motor control circuit. When relays R1-A and R3-A are energized, contacts R3A-A, R3B-A, R3C-A, R1D-A, R1E-A and R1F-A are opened to isolate both the potentiometer RC1-A, for the first machine 23, and the potentiometer 101 (RC2A) from the motor control circuit MC-23. Also, when relays R1-A and R3-A are energized, contacts R1A-A, R1B-A, R1C-A, R3D-A, R3E-A and R3F-A are closed providing a circuit path for the potentiometer 85 (DCR1) to the motor controller circuit MC-23. The contacts R1A-C, R1B-C and R1C-C remain open during operation of the machines, 23 and 24, in this mode. The system 20 will now be ready to enable the operator to select the base operating speed for the second machine 24.

Figure 9:
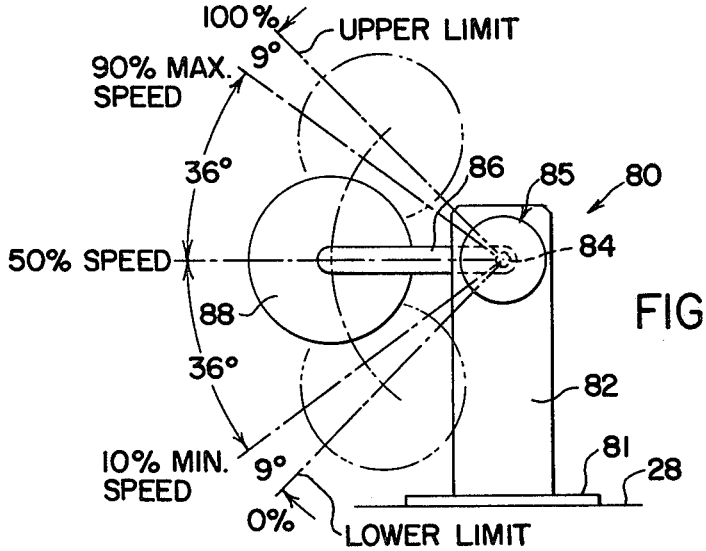
FIG. 9 is a schematic view of a speed controller component being used in an operating mode wherein the first machine covers a moving core element with a layer of strands having a relatively steep braid angle and the second machine covers the steep braid with a layer of strand having a relatively flat braid angle—a first pass slave-second pass master, mode.

FIG. 9 is intended to schematically show operating variables available to the operator in the second pass master-first pass slave mode. The input shaft 84 to the potentiometer 85 (DCR1) is intended to have a 90° total angular travel. At either side, an arc segment of 9° has been dedicated for use in stopping the operation of the drive motors 34 for each machine, 23 and 24. It has been found that an arc segment of 72° for movement of the wand 86 and roller 88 will enable the operator to effectively and accurately control the covering of a core element 21 at any operating speed chosen in the 10% to 90% range.

Referring again to FIGS. 10, 11B and 11C, the operator manually sets the potentiometer 105 (RC2C) to determine the base operating speed of the drive motor of the second machine 24. The roller 88 of the speed controller unit 80 is positioned so that the normally closed limit switches 93 and 94 (DSHLS and DSLLS, respectively) remain in a condition to energize the relay DSR1. The operator starts the machines 23 and 24 in tandem operation by momentarily depressing the "master run" button 112 (SW3).

The closing of contact SW3B provides 110 V current from line 3-C to relays R2-C and R5-C through contacts DSR1C, SW6B, SW7A, SW10B, SW3B, and R4D-C. Energizing relay R2-C opens contact R2A-C, which removes power from a suitably located safety or "motor off" indicator light L1-24. Energizing relay R5-C opens contact R5A-C and closes contacts R5B-C and R5C-C. The closing of contact R5B-C actuates the motor control circuit MC-24 to start operation of the second machine drive motor 34. Relay R5-C is held in an energized condition through contacts DSR1C, SW6B, SW7A, SW10B, SW2D, R6B-C and R5C-C.

Simultaneously, the closing of contact SW3A provides 110 V current from line 3-A to relays R2-A and R5-A through contacts DSR1B, SW7B, SW6A, SW10A, SW3A and R4D-A. Energizing relay R2-A opens contact R2A-A, which removes power from a suitably located safety or "motor off" indicator light L1-23. Energizing relay R5-A opens contact R5A-A and closes contacts R5B-A and R5C-A. The closing of contact R5B-A actuates the motor control circuit MC-23 to start operation of the first machine drive motor 34. Relay R5-A is held in an energized condition through contacts DSR1B, SW7B, SW6A, SW10A, SW2B, R6B-A and R5C-A.

In this mode, the operating speed and the power output of the drive motor for the second machine 24 is maintained constant, as determined by the operator setting of the potentiometer 105 (RC2C). The operating speed and the power output of the drive motor for the first machine 23 is automatically regulated by the potentiometer 85 of the speed controller unit 80.

Referring again to FIGS. 11A and 11C, the voltage output of the potentiometer 85 (DCR1) is transmitted to the motor control circuit MC-23. Any downward arcuate movement of the wand 86 and roller 88 will decrease the operating speed of the first machine drive motor. Any upward arcuate movement of the wand 86 and roller 88 will increase the operating speed of the firstmachine drive motor 34.

The safety or stop functions of the system 20, as described above with reference to the first mode of tandem operation, will also be operative in this mode.

Other Features

The operator may intentionally halt or stop both machines, 23 and 24, operating in either tandem mode, by depressing the "master emergency" stop button 114 (SW10) to de-energize the relays R5-A and R5-C.

The operator may simultaneously jog both machines, 23 or 24, operating in either tandem mode, by depressing the "master jog" button 113 (SW2). The closing of contact SW2A provides current for relay R5-A through contacts DSR1B, SW7B, SW6A, SW10A, SW2A and R4D-A, to operate the first machine 23. Simultaneously, the closing of contact SW2C provides current for relay R5-C through contacts DSR1C, SW6B, SW7A, SW10B, SW2C and R4D-C. When button 113 is continually depressed, contacts SW2B and SW2D are opened removing power from relays R6-A and R6-C which open contacts R6B-A and R6B-C in the run holding circuits. The machines, 23 and 24, will run only so long as button 113 (SW2) is depressed.

The connections between the operating buttons 116, 117 and 118 on the panel 115 of a control box 35 for each machine, 23 and 24, and electrical components depicted in FIGS. 11A and 11C have not been shown. It is considered that details of such connections could be supplied by a person of ordinary skill in the design and installation of electrical circuitry.

What is claimed is:

1. In a system for controlling the operating speeds of tandem machines for covering a moving flexible core element with multiple-layers of reinforcing strands in a process of continuous manufacture, the improvements comprising:

establishing the parameters of a chorded festoon having vertically aligned upper and lower parameters and extending laterally between first and second machines;

determining a vertically oriented zone of operational tolerance within said upper and lower parameters and substantially midway between the first and second machines;

continuously monitoring the position of a core element with a first layer of reinforcing strands thereon, during lateral movement from said first machine toward said second machine, at any point within the parameters of said chorded festoon;

detecting any position of said laterally moving core element which is changing within said zone of operational tolerance; and, automatically regulating the operating speed of one machine to correspond with the operating speed of the other machine to return the laterally moving core element from a detected changed position to a preselected position with said zone of operational tolerance.

2. In a system according to claim 1:

stopping the operation of said first and second machines when the monitored position of said laterally moving core element is detected as changing to exceed the parameters of said chorded festoon.

3. A system according to either claim 1 or claim 2, wherein each machine has a rotating braiding mechanism for braiding a layer of reinforcing strands around a flexible core element.

4. A system for the control of tandem braiding machines to cover a flexible core element with layers of braided reinforcing strands during successive passes through the braiding mechanisms of the machines, each machine having a powered rotating braiding mechanism and a powered revolving capstan drum for moving said core element coaxially through the braiding mechanism, comprising:

powering said braiding mechanism and said capstan drum of each machine from a single variable speed drive motor;

proportionally controlling the power output from each said drive motor to determine a specific braid angle for each layer of reinforcing strands;

establishing the parameters of a chorded festoon extending laterally between first and second machines and the extent of a vertically oriented zone of operational tolerance for lateral movement of said core element with a first layer of reinforcing strands thereon from said first machine toward said second machine;

moving said core element to pass through said braiding mechanism of the first machine and to pass through said braiding mechanism of the second machine by concurrent operation of the drive motor of each machine;

continuously monitoring the position of said moving core element at any point within the parameters of said chorded festoon;

detecting any position of said moving core element which is changing within said zone of operational tolerance; and, thereafter, regulating the speed of said power output of the drive motor for one machine while maintaining a constant speed for the power output of the drive motor of the other machine to return said moving core element from a detected changed position to a preselected position within said zone of operational tolerance.

5. A system according to claim 4, further comprising:

detecting any monitored position of said moving core element which is changing to exceed the parameters of said chorded festoon; and, thereafter, stopping the operation of the drive motor of each machine.

6. A system according to claim 4, wherein said first machine covers said moving core element with a layer of strands having a relatively flat braid angle and said second machine covers said flat braid with a layer of strands having a relatively steep braid angle;

and the speed of said power output of the drive motor for the second machine is regulated while maintaining a constant speed for said power output of the drive motor for the first machine to return said moving core element from a detected changed position to a preselected position within said zone of operational tolerance.

7. A system according to claim 4, wherein said first machine covers said moving core element with a layer of strands having a relatively steep braid angle and said second machine covers said steep braid with a layer of strands having a relatively flat braid angle;

and the speed of said power output of the drive motor for the first machine is regulated while maintaining a constant speed for said power output of the drive motor for the second machine to return said moving core element from a detected changed position to a preselected position within said zone of operational tolerance.

* * * * *

UNITED STATES PATENT AND TRADEMARK OFFICE

CERTIFICATE OF CORRECTION

PATENT NO. : 4,266,461

DATED : May 12, 1981

INVENTOR(S) : Thomas J. Molitors

It is certified that error appears in the above-identified patent and that said Letters Patent are hereby corrected as shown below:

Col. 1, line 13, "ad" should read --and--.

Col. 1, line 42, "circuar" should read --circular--.

Col. 2, line 60, "It is further" should read --It is a further --.

Col. 7, line 23, "intersection" should read --intersecting--.

Col. 9, line 20, "R7-A" should read --R7A-A--.

Col. 14, line 59, "firstmachine" should read --first machine--.

Signed and Sealed this

*Eleventh* Day of *August 1981*

[SEAL]

*Attest:*

GERALD J. MOSSINGHOFF

*Attesting Officer*

*Commissioner of Patents and Trademarks*